US005487250A

United States Patent [19]

Yount et al.

[11] Patent Number: 5,487,250

[45] Date of Patent: * Jan. 30, 1996

[54] PREDECORATED WALLBOARD JOINT AND METHOD OF JOINING PREDECORATED WALLBOARDS TO FORM A CONCEALED JOINT

[75] Inventors: Patty L. Yount, Lexington; Jacob E. Fisher, Jr., Granite Quarry, both of N.C.

[73] Assignee: J. P. Walls, Inc., Lexington, N.C.

[ * ] Notice: The portion of the term of this patent subsequent to May 17, 2011, has been disclaimed.

[21] Appl. No.: 199,565

[22] Filed: Feb. 22, 1994

Related U.S. Application Data

[63] Continuation of Ser. No. 859,472, Jun. 12, 1992, Pat. No. 5,311,717, which is a continuation-in-part of Ser. No. 452, 763, Dec. 14, 1989.

[51] Int. Cl.[6] ..... E04B 2/10

[52] U.S. Cl. ..... 52/417; 52/461; 52/467; 52/741.1

[58] Field of Search ..... 52/415, 416, 417, 52/467, 461, 396.04, 396.09, 366, 741.1

[56] References Cited

U.S. PATENT DOCUMENTS

| | | | |
|---|---|---|---|
| 2,814,080 | 11/1957 | Tvorik et al. . | |
| 3,708,935 | 1/1973 | Kossuth et al. . | |
| 4,059,933 | 11/1977 | Funk et al. . | |
| 4,157,271 | 6/1979 | Moore | 156/71 |
| 4,209,954 | 7/1980 | Scheid . | |
| 4,586,308 | 5/1986 | Jennings . | |
| 5,088,260 | 2/1992 | Barton et al. | 52/415 X |
| 5,333,433 | 8/1994 | Porambo et al. | 52/417 |

FOREIGN PATENT DOCUMENTS

| | | | |
|---|---|---|---|
| 142751 | 4/1961 | U.S.S.R. | 52/417 |

*Primary Examiner*—Carl D. Friedman
*Assistant Examiner*—Kevin D. Wilkens
*Attorney, Agent, or Firm*—Bell, Seltzer, Park & Gibson

[57] ABSTRACT

A wall formed from square edge predecorated wallboards and the method of constructing a seamless wall from square edge predecorated wallboards comprising folding the edge flaps of two abutting square edge wallboards away from the joint, cutting a groove along the length of the joint formed by the square edged abutting wallboards, adhering a joint strip comprising a rib which fits within the groove and a support strip therefor which extends laterally over the uncovered portion of each gypsum board adjacent to the joint, and double-cutting and adhering the edge flaps of the wallboards to the joint strip so as to form a seamless appearing joint.

12 Claims, 6 Drawing Sheets

PREDECORATED WALLBOARD JOINT AND METHOD OF JOINING PREDECORATED WALLBOARDS TO FORM A CONCEALED JOINT

CROSS-REFERENCE TO RELATED APPLICATIONS

This application is a continuation of application Ser. No. 07/859,472, filed Jun. 12, 1992 now U.S. Pat. No. 5,311,711, which is a continuation-in-part of U.S. patent application Ser. No. 452,763 filed Dec. 14, 1989.

BACKGROUND OF THE INVENTION (1) Field of the Invention

The invention relates to an improved method of forming the joint between two predecorated wallboards and an improved predecorated wall comprising abutting predecorated wallboards joined by said method.

(2) Description of the Prior Art

Predecorated wallboard building panels are widely used in the building industry, including the manufactured housing industry, to form relatively inexpensive and durable walls. Although the dimensions can vary, the predecorated wallboard building panels are typically manufactured in 120 cm.×240 cm. (4'×8'), 120 cm.×270 cm. (4'×9'), 120 cm.×300 cm. (4'×10'), and 120 cm.×360 cm. (4'×12') sizes and are nailed, screwed, or otherwise secured to wall studs. Although the predecorated wallboard building panels may be easily secured to the wall support studs to form a wall, it is well known in the art that the joints between the adjacent panels are difficult to hide or decorate in a manner so as to render them unobtrusive. In fact, although numerous solutions to the problem have been advanced, the problem has not been satisfactorily resolved until the development of the method of this invention of joining adjacent predecorated wallboards.

In fact, many prior art efforts at concealing the joint between predecorated wallboard building panels tend to emphasize the joint rather than create a monolithic, seamless wall. For example, U.S. Pat. No. 3,816,199 to Dawdy et al. discloses a concealed joint for the fastening of predecorated wallboard. The patent teaches pressing the edges of the predecorated sheet into joints formed between the panels and then inserting a decorative strip to hold the predecorated sheet edges in place in the joint. Similarly, U.S. Pat. No. 4,656,805 to Wenkowski discloses a paper batten for use in "concealing" the joints between predecorated gypsum wallboard. The batten is fabricated from predecorated wallboard paper with pressure-sensitive adhesive on the back thereof for securement over the joint. Unfortunately, it has been found that the paper battens tend to wrinkle and fall off. Moreover, the battens when in place are still noticeable and do not create the appearance of a monolithic or seamless wall.

In another method known to those familiar with the art of construction predecorated wallboard walls, wallboard with vinyl film or the like adhered to only the major center portion of the wallboard front face is used. The wallboard is formed with tapered side edges so that abutting wallboards are secured to wall studs by fasteners through the tapered side edge portions to which the vinyl covering is not adhered. Conventional joint compound (such as used in traditional gypsum wallboard joint filling) is then applied over the slight channel defined by the two abutting tapered wallboard side edge portions so as to conceal the fasteners and the joint in a manner similar to that in which joints and fasteners are concealed in standard drywall construction. Once the joint compound has been allowed to cure, the unadhered edge flaps of the vinyl film attached to the center of the wallboard are trimmed to precisely fit adjacent flaps, and the flaps are glued to the surface of the dried joint compound. If sufficient care is utilized in trimming and joining the abutting edge flaps, a monolithic wall appearance is achieved with this conventional predecorated wallboard wall construction. Such a system is described in U.S. Pat. No. 3,708,935 to Kossuth et al. and also discloses a concealed joint for the fastening of predecorated wallboard. Kossuth et al., however, use a tapered edge wallboard and the "mud system" for filling the channel between the sheets and the tapered area. However, a significant shortcoming is that this method requires the use of tapered edge wallboard and considerable skilled labor to properly finish the joints. The method of this invention for joining predecorated wallboards and the walls formed thereby provide for a similar monolithic appearance using and eliminates the need for skilled labor to form the "seamless" joints between adjacent predecorated wallboard building panels.

SUMMARY OF THE INVENTION

In accordance with the present invention, there is provided a predecorated wallboard joint and a method of joining predecorated wallboards to conceal the joints therebetween without the use of joint compound, battens, and similar conventional techniques now in use in building construction, particularly manufactured housing construction. This is accomplished by first attaching a pair of predecorated wallboards to wall studs or the like, in either abutting or closely adjacent relationship, the wallboards of the type each having a predecorated sheet adhered to the major central portion of the face of the undecorated wallboard and wherein the predecorated sheet is not adhered adjacent to the side edges of said wallboard and extends beyond the side edges thereof to form edge flaps.

In a preferred embodiment of this invention wallboard may have square edges and the method of installation is as follows. The edge flaps of the abutting predecorated wallboards are pulled back to expose the joint between the abutting wallboards and the surface area of the undecorated wallboard adjacent to the side edges thereof. A groove is then cut along at least a substantial portion of the length of the joint between the pair of abutting wallboards and within the square edges thereof, and a joint strip is adhered over at least a substantial portion of the length of the groove. The joint strip comprises a rib along the length thereof adapted to matingly fit within the groove and a support strip secured thereto which extends laterally over at least a portion of the undecorated wallboard adjacent to the side edge of each of the abutting wallboards. Finally, the edge flaps of the abutting wallboards are positioned in overlapping relationship, the overlapping portions of the edge flaps are removed, and the remaining portion of the edge flaps are adhered to the joint strip so as to form a smooth, seamless appearing joint surface between the predecorated square edge wallboards.

In another embodiment of this invention the wallboard may be made with preformed edges, say for example, at an angle such as a 45° angle or the like. In this embodiment the groove cutting step is eliminated.

It is therefore an object of the present invention to provide a monolithic appearing wall formed from square edge predecorated wallboard.

It is another object of the present invention to provide a monolithic appearing wall formed from predecorated wallboard which eliminates the need to fill joints with joint compound and the substantial skilled labor requirements to properly apply the joint compound.

It is a further object of the present invention to provide a monolithic appearing predecorated wallboard wall which may be quickly installed by unskilled labor without the mess and time delays associated with application of joint compound.

A still further object of this present invention is to provide a monolithic wall formed from predecorated wallboard of either the conventional square edged type or preformed at an angle.

It is a further object of the present invention to provide a monolithic appearing wall formed from predecorated wallboards wherein the method of forming the joints therebetween allows for and corrects variances in the manufacturing of the square edge predecorated wallboards.

It is yet another object of the present invention to provide a monolithic appearing wall formed from predecorated wallboard wherein less than full width predecorated wallboard panels can be joined together and the use thereof not be evident in the finished wall.

BRIEF DESCRIPTION OF THE DRAWINGS

Some of the objects of the invention having been stated, other objects will become evident as the description proceeds, when, taken in connection with the accompanying drawings, in which.

DETAILED DESCRIPTION OF THE PREFERRED EMBODIMENT

Figure 1:
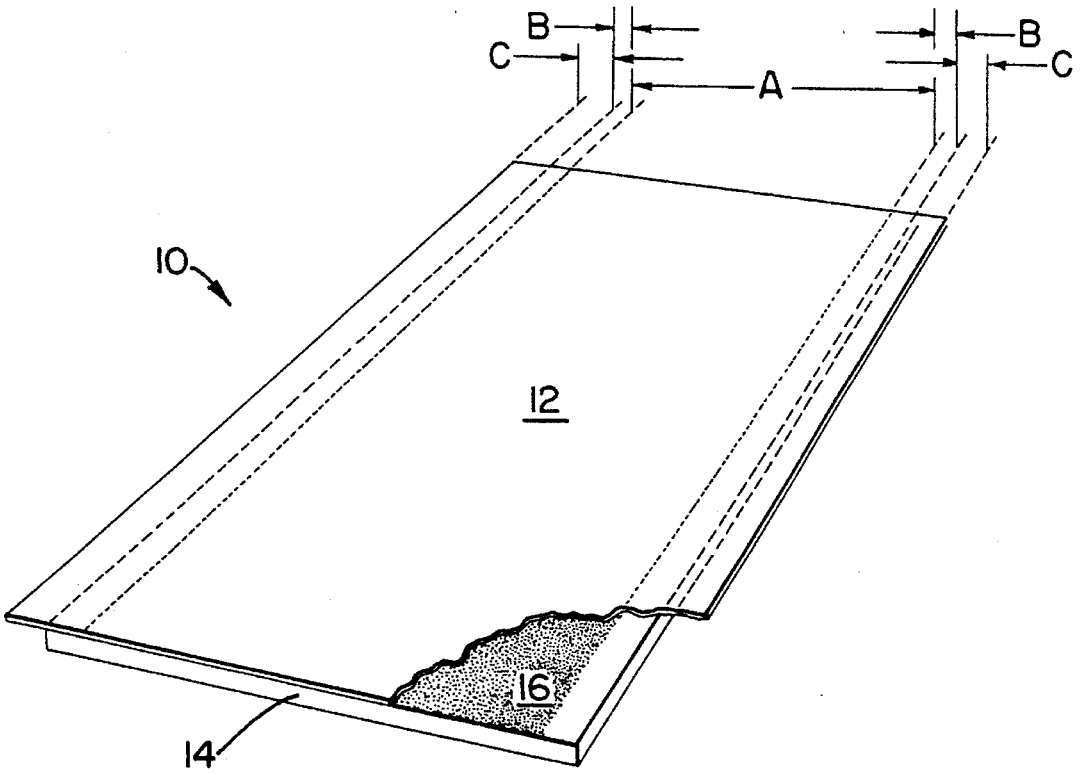
FIG. 1 is a perspective view of a square edge predecorated wallboard to be joined in accordance with the present invention.
Figure 2:
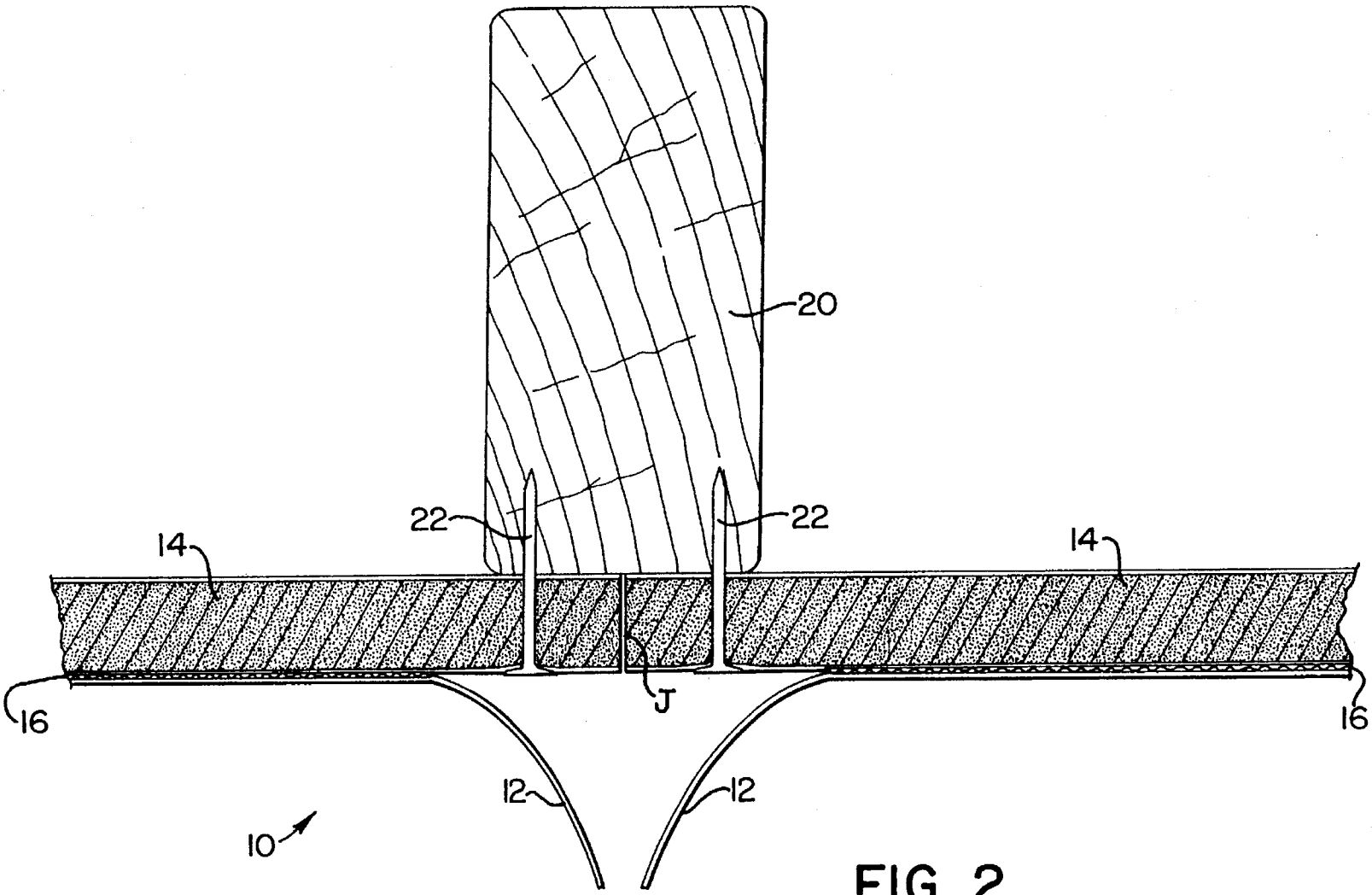
FIG. 2 is a horizontal cross-sectional view of two abutting predecorated wallboards secured to a stud and the edge flaps thereof turned back.

Referring now to the drawings, FIG. 1 shows as one embodiment a predecorated square edge wallboard (10) which comprises a predecorated sheet (12) which is adhesively secured to a square edge gypsum board (14) with adhesive (16). Predecorated sheet (12) is secured to central portion A of gypsum board (14) with adhesive (16) so as to allow for unsecured sections B adjacent to the Side edges of gypsum board (14). Also, predecorated sheet (12) is wider than gypsum board (14) and extends a distance C beyond each side edge thereof. Thus, edge flaps are formed on each side of predecorated wallboard (10) by sections B and C of predecorated sheet (12) which are not adhesively secured to gypsum board (14) therebeneath.

By way of further explanation, it should be appreciated that gypsum board (14) can be of varying size and may actually comprise any gypsum board, fiberboard, particleboard, epsom board, laminated paper, plastic or ceramic board for sue as the substrate for the predecorated square edge wallboard (10). It should be understood that in one embodiment of this invention square edged wallboard may be used and as explained in the description of FIGS. 2–7 a groove along the length of the joint is cut. Alternatively an angle or shaped edge may be preformed. While the angle is preferably formed at about 45°, it should be understood that the preformed angle or shape such as U-shaped, is of such shape as to smoothly accommodate a joint strip.

Predecorated sheet (12) also can be of varying size so long as it is at least 10.2 cm. (4 inches) wider than gypsum board (14), and sheet (12) may comprise embossed or unembossed paper, vinyl coated paper, vinyl with suitable backing, non-woven materials, fiberglass, fabrics, coated fabrics, and other materials suitable for serving as predecorated sheet material for square edge wallboard (10). It will be further appreciated that various suitable methods may be used to adhesively laminate predecorated sheet (12) to gypsum board (14) which include, by way of example only, using a water, solvent or epoxy based liquid adhesive to coat gypsum board (14) over the entire length thereof and up to a 7.6 cm. (3 inch) border on each side before sheet (12) is rolled or pressed onto gypsum board (14). Most suitably, predecorated sheet (12) has a minimum 2 inch overlap C on each edge of gypsum board (14).

In addition to the representative method of assembly of predecorated square edge wallboard (10) described above, the following techniques may also be utilized:

1. Liquid adhesive is applied to predecorated sheet (12) over the full length of the sheet less a minimum of 12.7 cm. (5 inches) on each side. For example, on a 132 cm. (52 inch) wide continuous role of predecorated sheet (12) to be applied to a 48 inch wide gypsum board (14), adhesive 16 should be applied to the center of sheet (12) to a controlled width of 96.7 cm. (42 inches). Once adhesive (16) is applied to sheet (12), the sheet should be centered and rolled or pressed onto gypsum board (14);
2. Pressure-sensitive adhesive (16) is applied to the full length and width of gypsum board (14), and when adhesive (16) is applied three inches of gypsum board (14) is covered adjacent to each edge with a release paper (not shown). Predecorated sheet (12) is centered and rolled or pressed onto the exposed pressure-sensitive adhesive (16) on gypsum board (14) so as to create a bond for the full length of gypsum board (14) and the width thereof less a 3 inch strip on each of gypsum board (14);
3. Pressure-sensitive adhesive (16) is centered and applied to gypsum board (14) for the full length thereof and the width thereof less a 7.6 cm. (3 inch) strip on each side so as to create a clean edge strip B, 7.6 cm. (3 inches) wide on each side: of the full length of gypsum board (14). Predecorated sheet (12) is then centered and rolled or pressed onto the exposed pressure-sensitive adhesive (16) creating a bond the full length of gypsum board

(14) and the width thereof less the 7.6 cm. (3 inch) strip B adjacent to each edge;

4. Pressure-sensitive adhesive (16) is applied to the back of predecorated sheet (12) for the full length and width thereof. A release paper is then applied to the edges of sheet (12) at a width to allow the adhesive-covered sheet (12) to be centered on gypsum board (14) with an exposed adhesive surface that is at a width of 15.2 cm. (6 inches) less than the width of gypsum board (14);
5. Pressure-sensitive adhesive (16) is centered and applied to the back of predecorated sheet (12) for the full length thereof and at a width that is 15.2 cm. (6 inches) less than the width of gypsum board (14). Predecorated sheet (12) is then centered over gypsum board (14) and pressed or rolled thereon so that sheet (12) overlaps the sides of gypsum board (14) by at least 5 cm. (2 inches);
6. A hot melt adhesive (16) in molten state is applied to gypsum board (14) for the full length and width thereof, and the adhesive is allowed to cool. Cooled hot melt adhesive (16) is then flash-heated in a controlled area that runs the full length of gypsum board (14) and a width that terminates 7.6 cm. (3 inches) from the side edges of gypsum board (14). Next, the predecorated sheet (12) is rolled or pressed onto gypsum board (14) so that it adheres to the full length of gypsum board (14) and for the width thereof less a 7.6 cm. (3 inch) strip along each side edge;
7. A hot melt adhesive (16) in its molten state is applied to gypsum board (14) for the full length and for the width thereof up to 7.6 cm. (3 inches) from the side edge so as to form two 7.6 cm. (3 inch) wide stripes B along each side edge of gypsum board (14) which do not have adhesive thereon. Predecorated sheet (12) is centered and rolled or pressed onto the adhesive face of gypsum board (14) so as to overlap the edges thereof by at least 5 cm. (2 inches). As an option, adhesive (16) on gypsum board (14) may be allowed to cool and then later flash-heated so that predecorated sheet (12) can be rolled or pressed thereon;
8. A hot melt adhesive (16) in its molten state is applied to the back of predecorated sheet (12) for the full length and width thereof. Adhesive (16) is allowed to cool, and predecorated sheet (12) is rolled up with a release paper to prevent sticking. Next, the release paper is removed from predecorated sheet (12) and adhesive (16) is reheated in a controlled area that is equal to the width of gypsum board (14), less 7.6 cm. (3 inches) on each side, and sheet (12) is then centered and rolled or pressed onto the face of gypsum board (14) so as to allow sheet (12) to extend a minimum of 5 cm. (2 inches) over each side edge of gypsum board (14). As an option, release paper strips (not shown) may be applied to the sides of predecorated sheet (12) to prevent the edges from adhering to the edges of the substrate;
9. A hot melts adhesive (16) in its molten state is applied to the back of sheet (12) in a controlled area that runs the full length thereof and to a width equal tot he width of gypsum board (14) less a 7.6 cm. (3 inch) strip B along each side edge thereof. Adhesive (16) is then allowed to cool and is rolled up with a release paper sandwiched therein to prevent sticking. Sheet (12) is later reheated to activate (16), and sheet (12) is then rolled or pressed onto gypsum board (14) so as to allow the edges C on each side to extend a minimum of 5 cm. (2 inches) beyond gypsum board (14).

Installation of Wallboard

With reference to FIGS. 2–7, the predecorated wallboard wall and the method of construction thereof can be further described. With specific reference now to FIG. 2 of the drawings, it can be seen that predecorated square edge wallboards (10) are placed in abutting position over wood stud (20) and nailed thereto with nails (22). It should be appreciated that the wallboards do not have to be placed in abutting relationship. The determination of the relationship of the wallboards to each other will depend upon the size of joint strip (30). Although wallboards (10) are depicted as nailed to a wooden stud, it is contemplated that predecorated square edge wallboards (10) of varying lengths, widths, and thicknesses may be nailed, screwed, stapled, glued, foamed or otherwise secured into place on metal, wood, fiberglass or plastic wall studs by centering joint J formed between abutting wallboards (10) over a stud.

Figure 6:
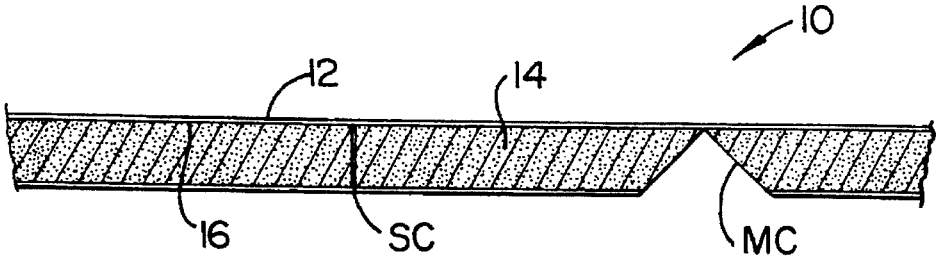
FIG. 6 is a horizontal cross-sectional view of a predecorated wallboard with two V-grooves cut in the back thereof so as to extend around two corners in a "seamless" fashion.
Figure 7:
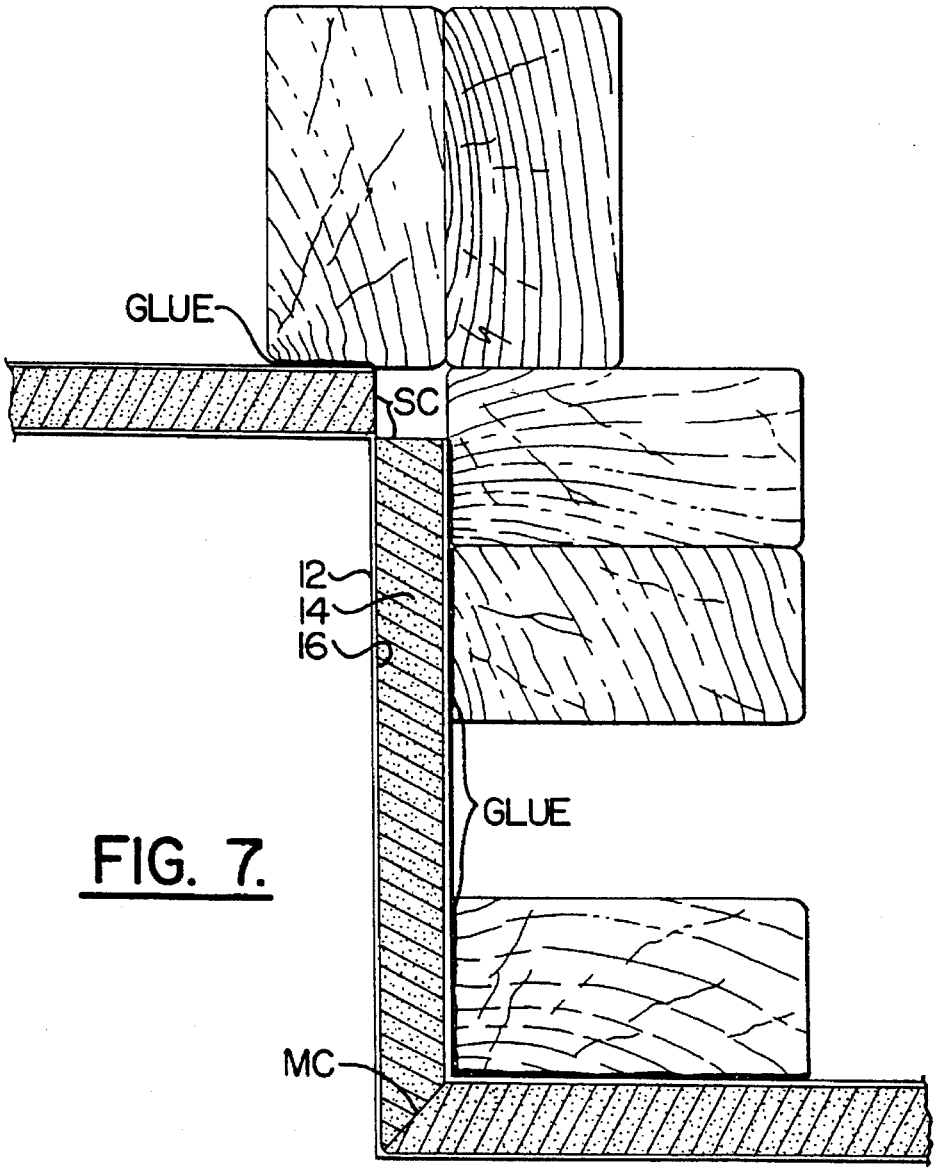
FIG. 7 is a horizontal cross-sectional view of the predecorated wallboard of FIG. 6 extending around two corners in a "seamless" fashion.

If wallboard (10) is wider than the wall being constructed or wallboard (10) must be continued around a wall corner, gypsum board (14) can be cut or mitered, as necessary, on the back side at a suitable location and at a depth which extends through gypsum board (14) but not through predecorated sheet (12) (see FIG. 6). In this fashion, sheet (12) acts as a "hinge" to allow gypsum board (14) to break away at corners while still allowing predecorated sheet (12) to continue in a seamless fashion. The mitered gypsum board (14) can be bent inward or outward to form inside or outside corners as the need may arise in wall construction (see FIG. 7). The mitered corner construction is shown in FIGS. 6 and 7 of the drawings with a single cut for inside corners designated as SC and the mitered cut for outside corners designated as MC therein.

Figure 3:
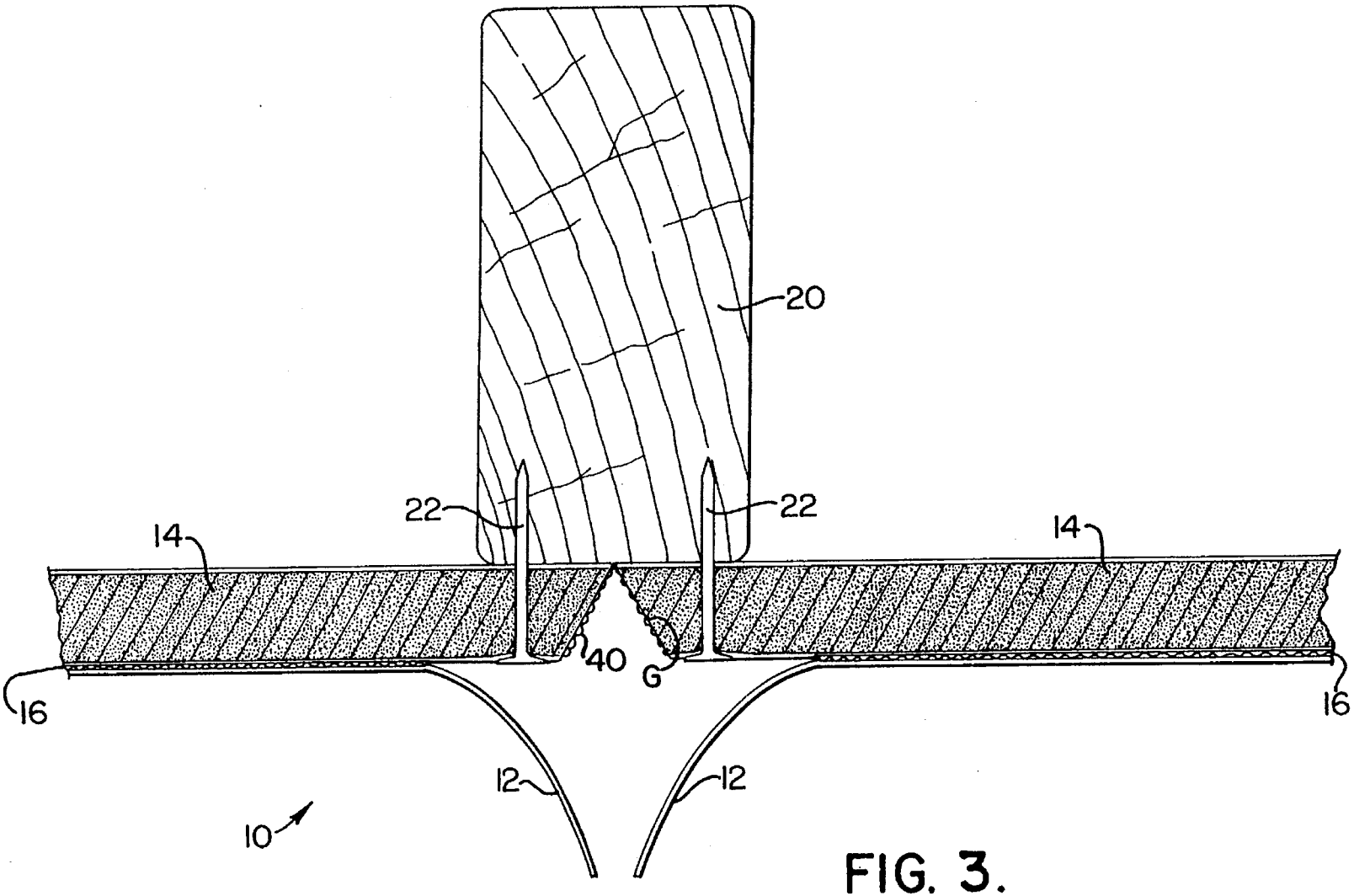
FIG. 3 is a horizontal cross-sectional view of the two abutting predecorated wallboards of FIG. 2 with a V-shaped groove cut in the joint formed between the abutting wallboards.

With reference now to FIG. 3, when adjacent wallboards (10) have been nailed to stud (20) in abutting relationship to form joint J, predecorated sheets (12) are pulled backward to expose a 7.6 cm. (3 inch) uncovered gypsum board surface strip adjacent the side edge of each gypsum board (14). For pressure-sensitive board coated method 2 and hot melt board coated method 6 described above, the uncovered edges will have a coating of adhesive (not shown) thereon whereas the side strips will not have adhesive thereon for predecorated wallboards laminated according to the remaining techniques also described hereinabove. A rotary cutter such as manufactured by Herco, Inc. of Newcomerstown, Ohio, is then used to cut a groove G along the length of joint J and within the square edges of adjacent wallboards (10). Most suitably, the rotary cutter travels along a vertical track and utilizes a suction apparatus therewith to clean cutting debris from groove G. Although a V-shaped groove is shown in FIG. 3, a U-shaped or modified rectangular groove may also be cut within joint J of butting predecorated wallboards (10). Applicants have discovered that the grooving process will plumb the joint and remove any irregularities in the thickness of the outside edges of gypsum board (14) as well as any irregularity in the straightness of the edges thereof, and further serves to plumb the joint to form a desirable straight vertical joint.

Figure 4:
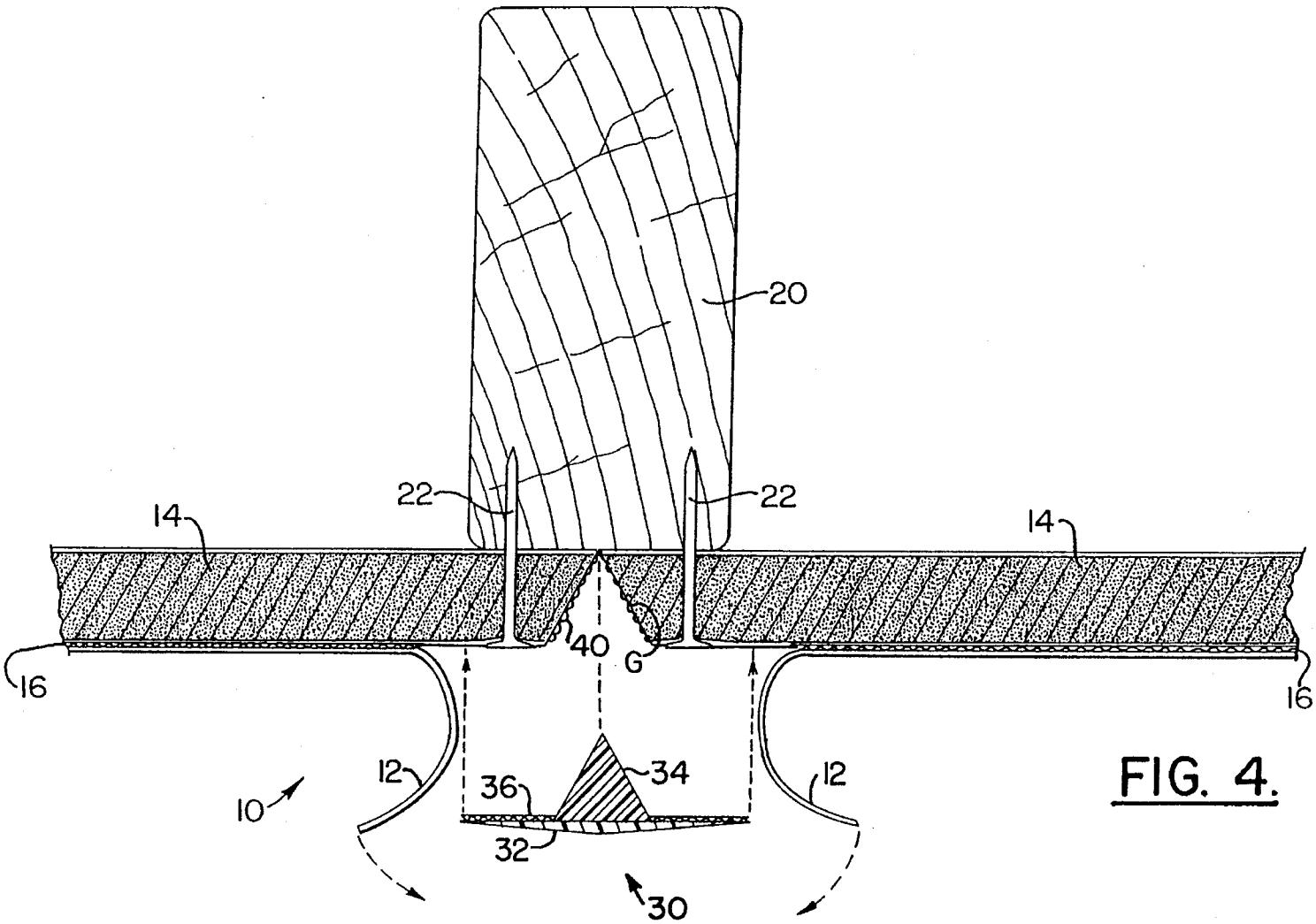
FIG. 4 is a horizontal cross-sectional view of the two abutting predecorated wallboards of FIG. 3 with a joint strip ready to be adhered to the groove formed in the joint therebetween.

Referring now to FIG. 4, joint strip (30) which is adhered to groove G can be seen. Most suitably, joint strip (30) comprises a support strip (32) about 10.2 to 12.7 cm. (4 to 5 inches) wide which is a semi-flexible strip of a suitable thickness which may be constructed of non-woven fabric, conventional fabric, coated fabric, cellulose, coated cellulose, paper, coated paper, plastic material or mixtures thereof. The edges of support strip (32) are sanded or beveled to a thickness of about 1 mil. Rib (34) is adhesively secured to support strip (32) and may be constructed of PVC, cellulose, rubber material or mixtures thereof. Rib (34) is adhesively affixed to support strip (32) so as to allow for flexing of joint strip (30) without delamination occurring. Also, the shape and dimensions of rib (34) are determined by the shape of groove G, which it will normally correspond to in size and shape. Prior to insertion of joint strip (30) into groove G, groove G is coated with a bead or the like of caulking. If predecorated wallboards (10) are manufactured using liquid adhesives applied to either the board or sheet (the first representative method and method 1 above), pressure-sensitive adhesive applied to the gypsum board or predecorated sheet according to methods 3, 4 and 5 above, or hot melt adhesive applied to the gypsum board or predecorated sheet according to methods 7, 8 and 9 above, an adhesive (36) will be applied to the back of support strip (32) in the form of either pre-applied hot melt adhesive, pre-applied pressure-sensitive adhesive with release paper or liquid adhesive applied at time of installation. If predecorated wallboards (10) are manufactured using pressure-sensitive board coating according to method 2 above or hot melt glue board coating according to method 6 above, adhesive (36) does not have to be applied to joint strip (30) prior to adherence thereof to groove G. Regardless of the source of adhesive used to secure joint strip (30) to groove G, the bonding thereof creates a smooth joint between gypsum boards (14) without the necessity for sanding, puttying or filling of the joint or the necessity of covering the joint with battens or the like. This is very significant since applicants' joint eliminates the mess and drying time required for cement filler as well as the necessity for use of skilled laborers to form a smooth joint. Moreover, if the simple expedient of attaching battens were to be used to cover the joint, the appearance of the fully constructed wall is not monolithic and, in fact, is unattractive due to the presence of periodic batten strips thereon.

Figure 5:
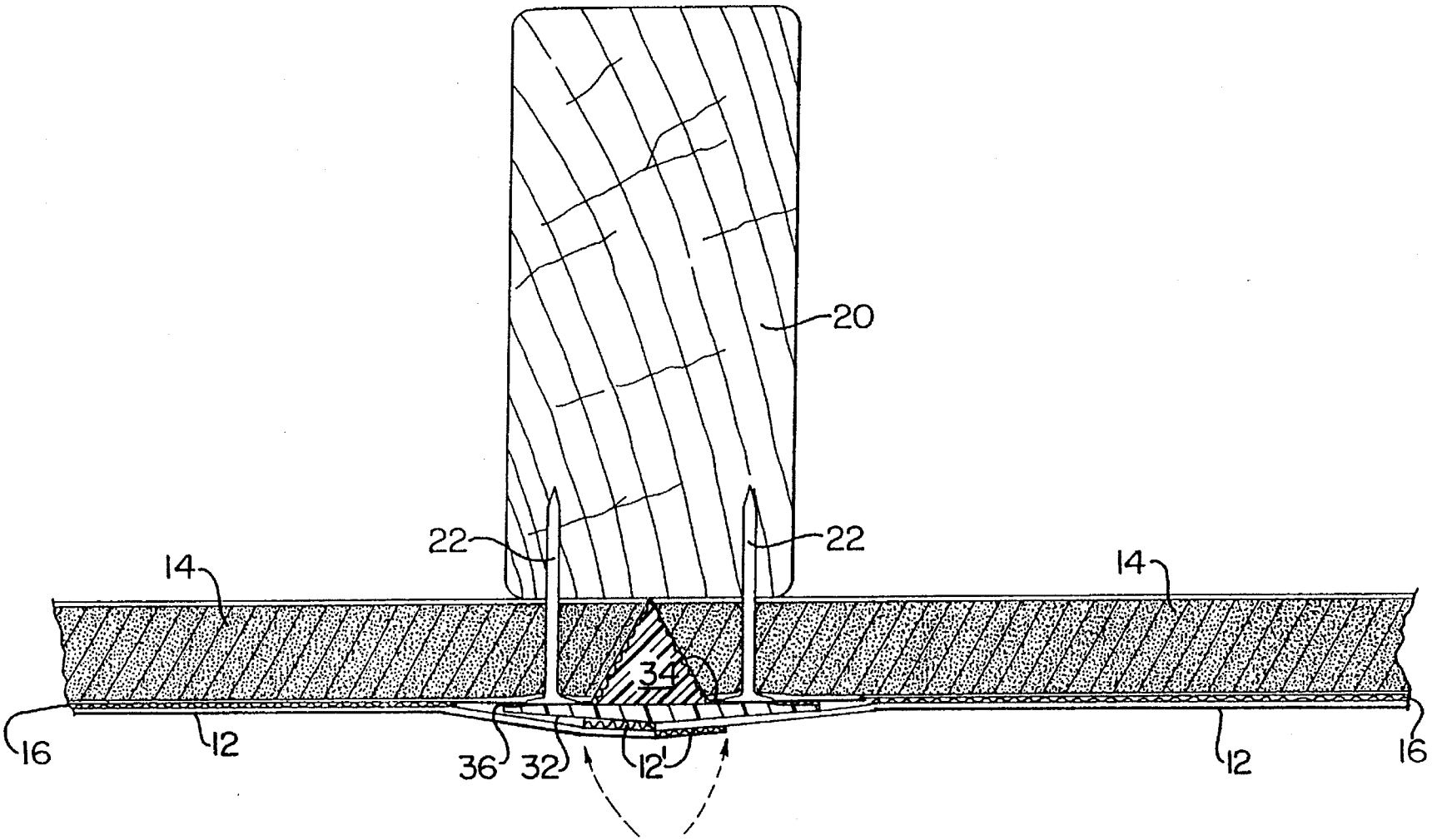
FIG. 5, is a horizontal cross-sectional view of the two abutting predecorated wallboards with the joint therebetween having been completed in accordance with the present invention to form a monolithic and seamless appearing wall.

Referring finally to FIG. 5 of the drawings, it can be appreciated that in order to fully finish the smooth joint formed by the adherence of joint strip (30) to groove G, the edge flaps of predecorated sheets (12) are released and allowed to overlap. Next, a vertical cut is made through both edge flaps with a metal straight edge and razor blade or knife, and the edge flaps are peeled back and loose edge strips (12') are removed. It should be noted that if predecorated wallboards (10) were formed by applying pressure-sensitive adhesive to predecorated sheets (12) in accordance with method 4 above, it will be necessary to remove the strips of release paper from the back of predecorated sheets (12) prior to adhering the double-cut edges to joint strip (30). If wallboards (10) were formed by hot melt adhesive coating of sheet (12) in accordance with method 8 above, it will be necessary to apply heat to the double-cut edge flaps to iron the remaining strips into place over joint strip (30). If the predecorated wallboards were manufactured according to any of the remaining methods described above, it will be necessary to apply a coat of liquid adhesive (water, solvent or epoxy based) to the back of joint strip (30) and to press the double-cut edge flaps into place thereon.

In should be appreciated that although certain features of the invention are shown in slightly enlarged representation in several drawings for greater clarity of understanding, the wallboard joint contemplated by the invention is substantially flat and parallel to the outer wall surfaces and thus forms a "seamless" and monolithic appearing wall.

It will be understood that various details of the invention may be changed without departing from the scope of the invention. Furthermore, the foregoing description is for the purpose of illustration only, and not for the purpose of limitation—the invention being defined by the claims.

What is claimed is:

1. A predecorated wall comprising:

adjacent predecorated wallboards having preformed edge portions forming a joint (J) therebetween, said wallboards of the type each having a predecorated sheet adhered to the major central portion of the outward face of the undecorated wallboard wherein the predecorated sheet is not adhered adjacent to the preformed side edges of said wallboard and extends beyond the preformed side edges thereof to form edge flaps;

said joint (J) forming a groove (G) provided within the preformed edges of said adjacent wallboards along at least a substantial portion of the length of the joint formed therebetween;

a joint strip comprising a support strip which extends laterally over at least a portion of the undecorated wallboard adjacent to the preformed side edge of each of said adjacent wallboards and a rib along the length thereof adapted to matingly fit within said groove and said support strip and said rib being adhesively secured thereto; and a smooth seam formed over said joint strip by said flaps having been suitably double-cut and adhesively secured thereto.

2. The predecorated wall according to claim 1 wherein said adjacent wallboards are secured to a wall stud beneath said joint.

3. The predecorated wall according to claim 1 wherein said groove comprises a V-shaped groove and said rib of said joint strip defines a V-shaped rib of substantially the same size.

4. The predecorated wall according to claim 1 wherein said joint strip comprises a semi-flexible support strip comprising side edges about 1 mil in thickness.

5. The predecorated wall according to claim 1 wherein said support strip comprises a material selected from the group consisting of fabric, paper, cellulose, plastic, and mixtures thereof.

6. The predecorated wall according to claim 1 wherein caulking is provided in said groove.

7. A predecorated wall comprising:

adjacent predecorated wallboards having preformed edge portions forming a joint (J) therebetween, said wallboards of the type each having a predecorated sheet adhered to the major central portion of the outward face of the undecorated wallboard wherein the predecorated sheet is not adhered adjacent to the preformed side edges of said wallboard and extends beyond the preformed side edges thereof to form edge flaps;

said joint (J) forming a groove (G) provided within the preformed edges of said adjacent wallboards along at least a substantial portion of the length of the joint formed therebetween;

a joint strip comprising a support strip which extends laterally over at least a portion of the undecorated wallboard adjacent to the preformed side edge of each of said adjacent wallboards and a rib along the length thereof adapted to matingly fit within said groove and said support strip and said rib being adhesively secured thereto, wherein said rib is semi-flexible and adhesively secured to said support strip; and a smooth seam formed over said joint strip by said flaps having been suitably double-cut and adhesively secured thereto.

8. A predecorated wall comprising:

adjacent predecorated wallboards having preformed edge portions forming a joint. (J) therebetween, said wallboards of the type each having a predecorated sheet adhered to the major central portion of the outward face of the undecorated wallboard wherein the predecorated sheet is not adhered adjacent to the preformed side edges of said wallboard and extends beyond the preformed side edges thereof to form edge flaps;

said joint (J) forming a groove (G) provided within the preformed edges of said adjacent wallboards along at least a substantial portion of the length of the joint formed therebetween;

a joint strip comprising a support strip which extends laterally over at least a portion of the undecorated wallboard adjacent to the preformed side edge of each of said adjacent wallboards and a rib along the length thereof adapted to matingly fit within said groove and said support strip and said rib being adhesively secured thereto, wherein said rib comprises a material selected from the group consisting of PVC, cellulose, rubber, and mixtures thereof; and a smooth seam formed over said joint strip by said flaps having been suitably double-cut and adhesively secured thereto.

9. A method of joining predecorated wallboards so as to conceal the joints therebetween comprising:

attaching a pair of predecorated wallboards in adjacent relationship to wall studs or the like forming a joint therebetween, said wallboards each having a predecorated sheet adhered to the major central portion of the outward face of the undecorated wallboard and wherein the predecorated sheet is not adhered adjacent to the side edges of said wallboard and extends beyond the side edges thereof to form edge flaps, said wallboard side edges being preformed to form a groove therebetween when attached to wall studs at said joint;

pulling said adjacent edge flaps of said adjacent predecorated wall boards back to expose said groove between said wallboards and the surface area of undecorated wallboard adjacent to the side edges thereof;

adhering a joint strip over at least a substantial portion of the length of said groove, said joint strip comprising a rib along the length thereof adapted to matingly fit within said groove and a support strip secured thereto which extends laterally over at least a portion of the undecorated wallboard adjacent to the side edge of each of said adjacent wallboards, said support strip and said rib being adhesively secured to said groove;

releasing said edge flaps of said adjacent predecorated wallboards and positioning said flaps in overlapping relationship; and removing overlapping portions of said edge flaps and adhering said remaining portions of said edge flaps to said joint strip to form a smooth surface.

10. The method according to claim 9 comprising nailing adjacent wallboards to a wall stud beneath said joint.

11. The method according to claim 9 wherein said surface area adjacent to the side edge of each of said undecorated wallboards does not comprise an adhesive thereon.

12. The method according to claim 9 including the steps of applying adhesive to said surface area adjacent to the side edge of each of said undecorated wallboards.

* * * * *

UNITED STATES PATENT AND TRADEMARK OFFICE
CERTIFICATE OF CORRECTION

PATENT NO. : 5,487,250

DATED : January 30, 1996

INVENTOR(S) : Patty L. Younts, Jacob E. Fisher, Jr.

It is certified that error appears in the above-identified patent and that said Letters Patent is hereby corrected as shown below: On the title page, Item [19 & 75]

Inventor, "Yount" should be -- Younts --.

Column 1, line 8, after "1992" insert a comma (,); "5,311,711" should be -- 5,311,717 --.

Column 1, line 10, before "filed" insert a comma (,).

Column 3, line 9, "this" should be -- the --.

Column 3, line 29, after "when" omit the comma (,).

Column 3, line 46, after "5" omit the comma (,).

Column 3, line 54 "FIG," should be -- FIG. --.

Column 3, line 67, "Side" should be -- side --.

Column 4, line 11, "sue" should be -- use --.

Column 4, line 18, after "shape" insert a comma (,).

Column 4, line 43, "role" should be -- roll --.

UNITED STATES PATENT AND TRADEMARK OFFICE
CERTIFICATE OF CORRECTION

PATENT NO. : 5,487,250 Page 2 of 2

DATED : January 30, 1996

INVENTOR(S) : Patty L. Younts, Jacob E. Fisher, Jr.

It is certified that error appears in the above-identified patent and that said Letters Patent is hereby corrected as shown below:

Column 4, line 45, "16" should be -- (16) --.

Column 4, line 58, omit "of" before "gypsum".

Column 4, line 64, after "side" omit the colon (:).

Column 5, line 32, "stripes" should be -- strips --.

Column 5, line 59, "tot he" should be -- to the --.

Column 5, line 64, before "(16)" insert -- adhesive --.

Column 6, line 52, "butting" should be -- abutting --.

Column 7, line 59, "In" should be -- It --.

Column 9, line 3, after "joint" omit the period (.).

Column 10, line 6, "wall boards" should be -- wallboards --.

Signed and Sealed this

Twenty-fifth Day of June, 1996

*Attest:*

Bruce Lehman

BRUCE LEHMAN

*Attesting Officer*

*Commissioner of Patents and Trademarks*